United States Patent [19]

Hayashi et al.

[11] Patent Number: 4,467,754

[45] Date of Patent: Aug. 28, 1984

[54] AUTOMOTIVE INTERNAL COMBUSTION ENGINE

[75] Inventors: Yoshimasa Hayashi, Kamakura; Yoshikazu Hayakawa, Yokosuka; Naoki Ogawa, Yokohama, all of Japan

[73] Assignee: Nissan Motor Company, Limited, Yokohama, Japan

[21] Appl. No.: 327,968

[22] Filed: Dec. 7, 1981

[30] Foreign Application Priority Data

Dec. 11, 1980 [JP] Japan ..... 55-175083

[51] Int. Cl.[3] ..... F02F 7/00

[52] U.S. Cl. ..... 123/195 H; 123/195 R; 123/195 C; 384/429; 384/432; 74/606 R

[58] Field of Search ..... 123/195 R, 195 C, 195 H; 74/606 R; 180/292; 384/429

[56] References Cited

U.S. PATENT DOCUMENTS

| | | | |
|---|---|---|---|
| 2,681,054 | 6/1954 | Boghossian | 123/195 R |
| 3,942,502 | 3/1976 | Gorres et al. | 123/195 R |
| 4,245,595 | 1/1981 | Abe et al. | 123/195 C |
| 4,280,453 | 7/1981 | List et al. | 123/195 R |

FOREIGN PATENT DOCUMENTS

| | | |
|---|---|---|
| 2010394 | 6/1979 | European Pat. Off. . |
| 2302995 | 3/1977 | Fed. Rep. of Germany . |
| 1422703 | 1/1976 | United Kingdom . |

OTHER PUBLICATIONS

*Automobiltechnische Zeitschrift*, vol. 80, No. 5, H. Droscha, "Preisgekroente Kurbelgehaeuse-Konstruktion", p. 228, (1978).

*Primary Examiner*—Craig R. Feinberg
*Assistant Examiner*—David A. Okonsky
*Attorney, Agent, or Firm*—Schwartz, Jeffery, Schwaab, Mack, Blumenthal & Koch

[57] ABSTRACT

An automotive internal combustion engine comprises a cylinder block having at its bottom section a plurality of main bearing supporting sections, a bearing beam structure secured to the cylinder block bottom section and including a plurality of main bearing caps each cooperating with a main bearing supporting section of the cylinder block, and a beam section securely connecting the main bearing caps with each other, and a support arm disposed on an end portion of the bearing beam structure and rigidly connected to the lower section of a transmission bell housing, thereby effectively suppressing the angular displacement of the cylinder block relative to the transmission bell housing.

9 Claims, 8 Drawing Figures

AUTOMOTIVE INTERNAL COMBUSTION ENGINE

BACKGROUND OF THE INVENTION

1. Field of the Invention

This invention relates to a low-noise level internal combustion engine of an automotive vehicle, and more particularly to an improvement in the contacting connection between an engine block and a transmission to achieve a vibration noise reduction.

2. Description of the Prior Art

In connection with automotive internal combustion engines, an engine block is usually rigidly connected to and in straight alignment with a transmission. However, the connection of the engine block to the transmission is not made through the whole area of the front end section of a transmission bell housing, i.e. the connection surface area between the engine block and the transmission is relatively small. As a result, an angular displacement between the engine block to the transmission is liable to occur, thereby lowering the flexural and torsional rigidities of the connecting section of the both. This causes various sections of a power plant to tend to vibrate, contributing to a total vehicle noise increase.

BRIEF SUMMARY OF THE INVENTION

In accordance with the present invention, an automotive internal combustion engine comprises a cylinder block having a bottom section with a plurality of main bearing support sections each carrying a main bearing. A bearing beam structure is secured to the bottom section of the cylinder block and includes a plurality of main bearing cap sections each supporting the main bearing and cooperating with each main bearing support section of the cylinder block. The main bearing cap sections are securely connected with each other by a beam section. The bearing beam structure is integrally formed at its one end portion with a support arm section which extends downwardly relative to the cylinder block and rigidly connects with a the bottom section of the bell housing of a transmission. With this arrangement, the connecting stiffness of an engine block to the transmission is improved, thereby greatly reducing noise due to angular displacement of the engine block relative to the transmission.

BRIEF DESCRIPTION OF THE DRAWINGS

The features and advantages of the automotive internal combustion engine according to the present invention will be more clearly appreciated from the following description taken in conjunction with the accompanying drawing in which like reference numerals designate the corresponding parts and elements, and in which.

DETAILED DESCRIPTION OF THE INVENTION

Figure 1:
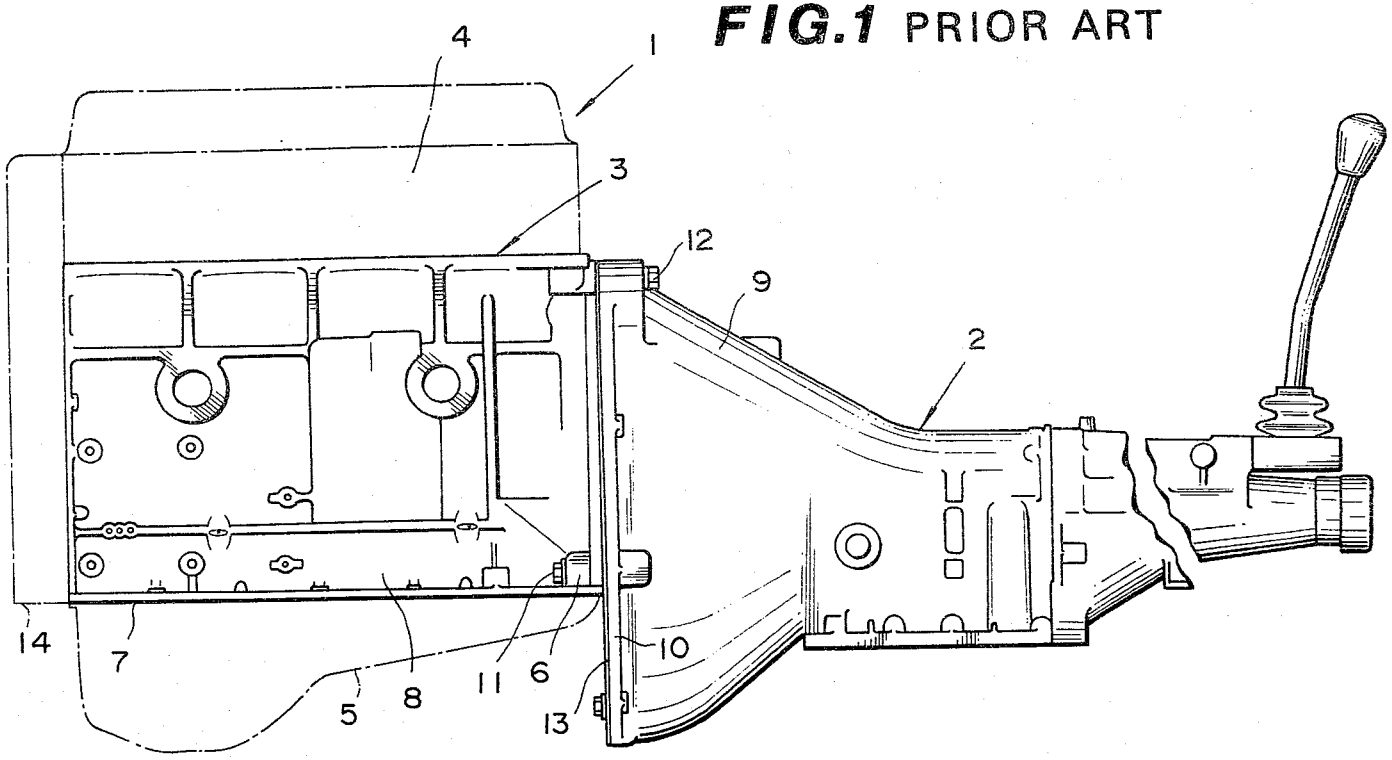
FIG. 1 PRIOR ART
FIG. 1 is a side elevation of a conventional automotive power plant having a transmission.

To facilitate understanding the present invention, a brief reference will be made to a conventional automotive internal combustion engine 1 provided with a transmission 2, depicted in FIG. 1. The engine 1 consists of a cylinder block 3 to which a cylinder head 4 and an oil pan 5 are installed. The cylinder block 3 is formed with transmission installation sections 6 which are oppositely located and project outwardly. Each transmission installation section 6 is integral with an oil pan installation flange 7 to which the oil pan 5 is secured. The oil pan installation flange 7 is formed at the lower part of a so-called skirt section 8 of the cylinder block 3. The transmission 2 consists of a bell housing 9 which is formed with a peripheral flange 10. The peripheral flange 10 is rigidly connected to the cylinder block 3 in such a manner as to be secured at its opposite side locations to the transmission installation sections 6 with bolts 11 and at its top section to the top section of the cylinder block 3 with a bolt 12. A disc-type end plate 13 is interposed between the rear end section of the cylinder block 3 and the bell housing flange 10 of the transmission 2. The reference numeral 14 designates an engine front cover.

However, with such a conventional arrangement, a drawback has been encountered in that the surface area of connection between the cylinder block 3 and the transmission 2 is small and accordingly angular displacement tends to occur between the cylinder block 3 and the transmission 2, and the connecting section between the cylinder block 3 and the transmission 2 is lower in flexural and tortional rigidity. This may cause a propeller shaft (not shown) to vibrate and contributes to increasing the vibration of cylinder block itself, thereby increasing total vehicle noise. In adddion, with respect to the cylinder block 3, main bearing caps (not shown) tend to vibrate in the direction to cause the bearing caps to loosen. These main bearing caps cooperate with main bearing supporting sections (not shown) formed at the bottom part of the cylinder block 3 to support the crankshaft. Loosening of the main bearing caps induces secondary vibrations, such as lateral movement vibration of the skirt section 8 and vibration of the oil pan 5 and the front cover 14, which constitutes a major source of engine noise.

Figure 2:
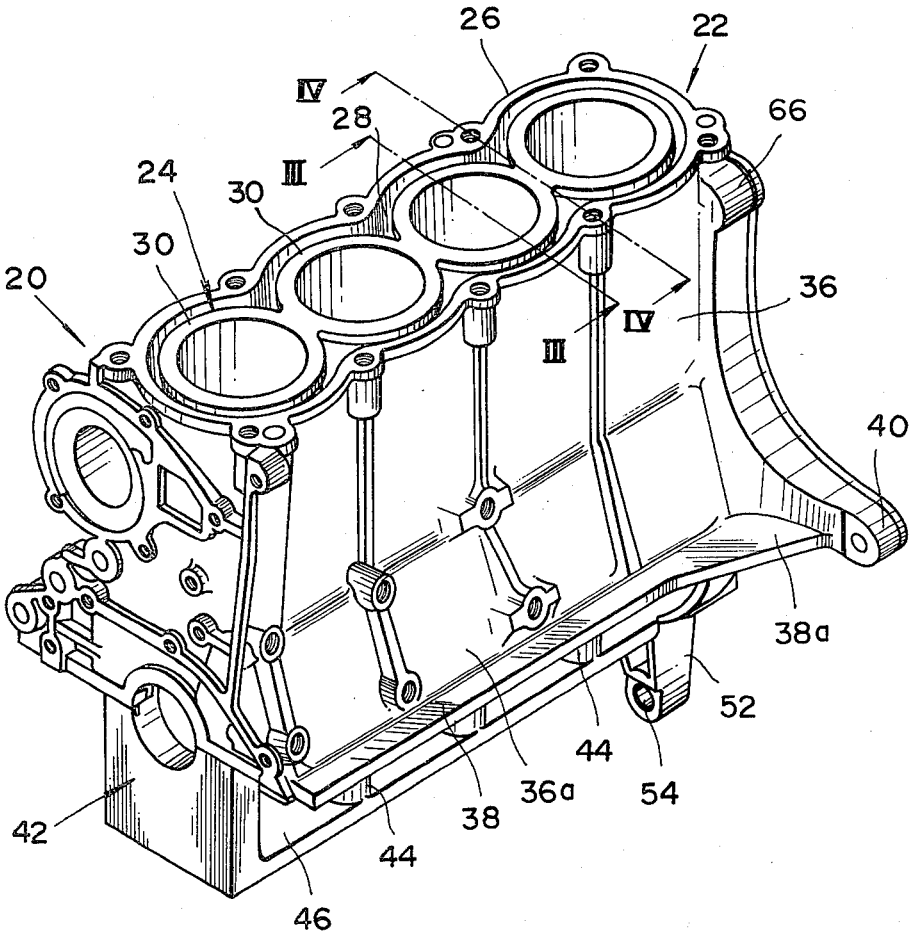
FIG. 2 is a perspective view of an engine block of a preferred embodiment of an automotive internal combustion engine in accordance with the present invention.
Figure 3:
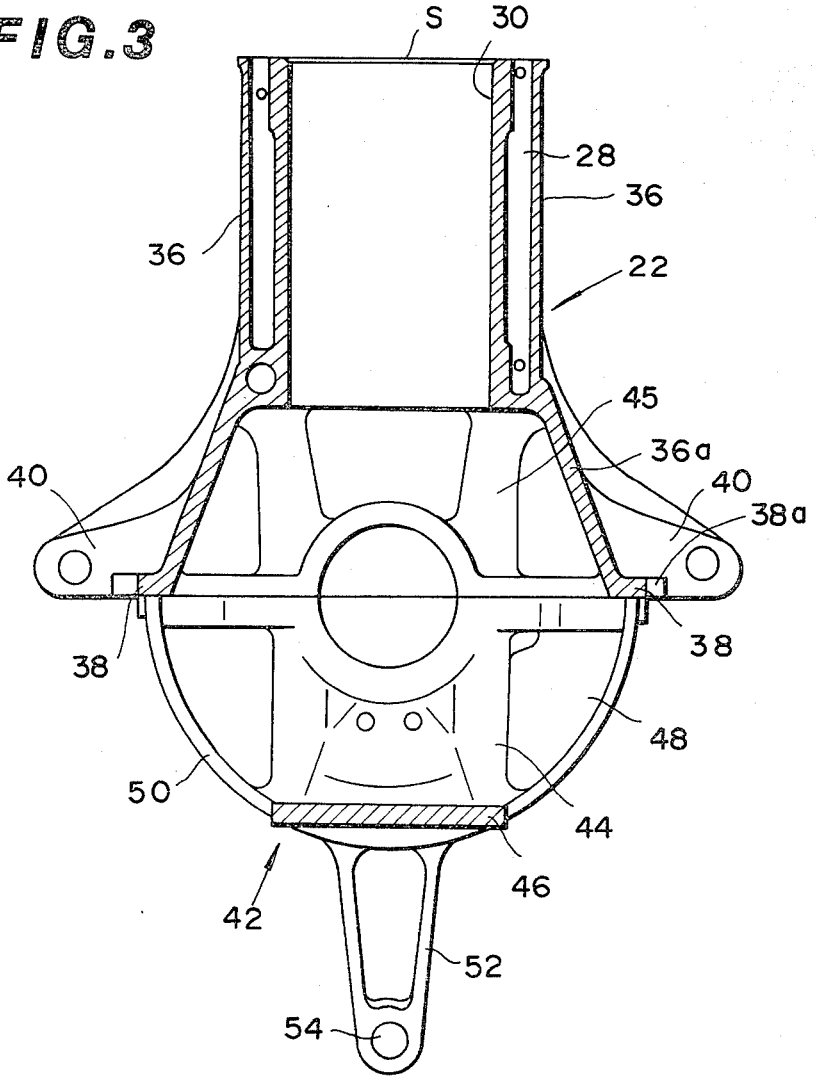
FIG. 3 is a sectional view taken in the direction of the arrows substantially along the line III—III of FIG. 2.
Figure 4:
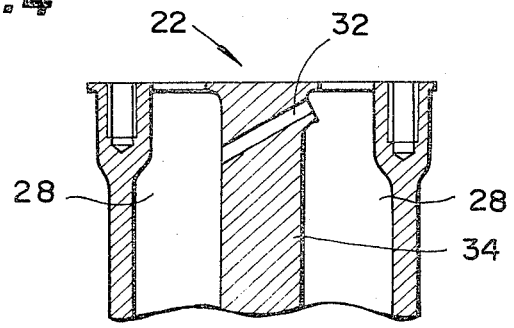
FIG. 4 is a fragmentary sectional view taken in the direction of the arrows substantially along the line IV—IV of FIG. 2.

In view of the above description of the conventional engine arrangement, reference is now made to FIGS. 2 to 7, and more specifically to FIGS. 2 and 3, wherein a preferred embodiment of an internal combustion engine of an automotive vehicle, according to the present invention is illustrated by the reference numeral 20. The engine 20 comprises a cylinder block 22 of the type wherein no upper block deck is provided, i.e. a cylinder-barrel structure 24 is separate, at a section including the top surface S of the cylinder block 22, from a surrounding or outer wall section 26 of the cylinder block 22 to define therebetween a water jacket 28. The cylinder-barrel structure 24 includes a row of aligned cylinder barrels 30 which are integrally connected with each other, side-by-side, for the sake of compensating cylinder block rigidity for the cylinder block of the no upper block deck type. As shown in FIG. 4, a through-hole 32 is formed through a connecting wall section 34 through which two adjacent cylinder barrels 30 are integrally connected with each other. The through-hole 32 connects portions of the water jacekts 28, located opposite relative to the cylinder barrel structure 24 in order to improve the cooling effect to the cylinder barrels 30.

The surrounding wall section 26 includes two opposite side walls 36 each of which has at its lower part a so-called skirt section **36*a* which is gradually widened toward the bottom-most section of the cylinder block 22. The skirt section 36*a* defines thereinside a upper part of a crankcase (not shown). In this instance, the skirt section 36*a* is formed plain or straight in order to decrease the surface area through which noise radiates. A reinforcement rib 38 is integrally formed at the cylinder block side wall 36 along the horizontal bottom part of each skirt section 36*a*. The reinforcement rib 38 extends from the front end to rear end sections of the cylinder block 22 and has an widened section 38*a*. The widened section 38*a* is integral with a transmission installation section 40 which is integral with the rear end section of the cylinder block 22** and projects outwardly.

A bearing beam structure 42 is rigidly connected to the bottom section of the cylinder block 22. The bearing beam structure 42 includes a plurality of main bearing cap sections 44 each of which cooperates with one of a plurality of main bearing supporting sections or main bearing bulkheads formed at the bottom section of the cylinder block 22. Each main bearing cap section 44 is formed with a semicylindrical recess for carrying a bearing metal (not shown), while each main bearing supporting section 45 of the cylinder block 22 is formed with a semicylindrical recess for carrying the bearing metal, so that the journal of a crankshaft is rotatably supported through the bearing metal by the associated or combined bearing cap section 44 and bearing supporting section 45 of the cylinder block 22, though not shown. The corresponding bearing cap section 44 and cylinder block main bearing supporting section 45 are secured to each other by using bolts (not shown). The bearing beam structure 42 further includes a horizontal beam section 46 which connects the bearing cap sections 44 with each other so that the bearing beam structure 42 serves as a one-piece. The bearing beam structure 42 is, for example, integrally cast.

Figure 6:
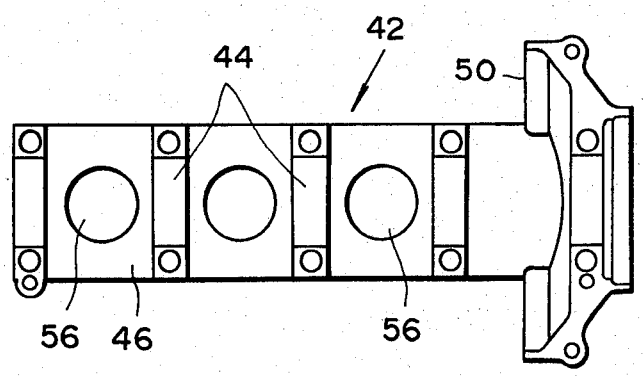
FIG. 6 is a plan view of a modified example of a bearing beam structure according to the present invention.
Figure 7:
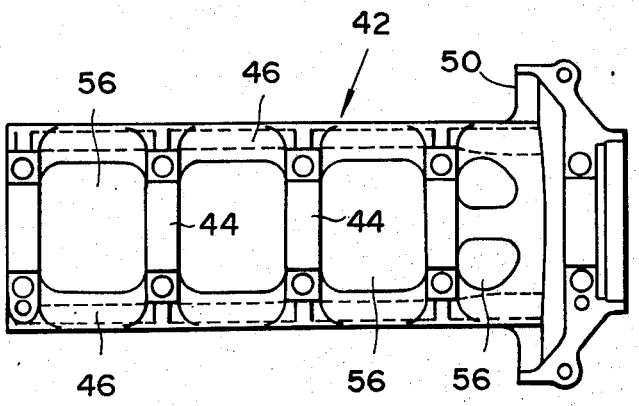
FIG. 7 is a plan view similar to FIG. 6, but showing another modified example of the bearing beam structure.

The bearing beam structure 42 is integrally formed at its rear end section with a semicircular wall portion 48 which is provided along its periphery with a semicircular rib 50. The bearing beam structure 42 is further integrally formed with a support arm section 52 which projects downwardly or parallelly with the axes of cylinder barrels 30 in such a manner as to extend from the semicircular wall portion rib 50. The arm section 52 is formed at its end portion with a through-hole 54 for a bolt. The arm section 52 has a flat surface F (FIG. 5) which contacts a rear plate 53 to which a bell housing flange 62 is connected. The beam section 46 may be formed with suitable openings 56 each of which is located between adjacent bearing cap sections 44 for the sake of lightening the bearing beam structure weight, as shown in FIGS. 6 and 7.

Figure 5:
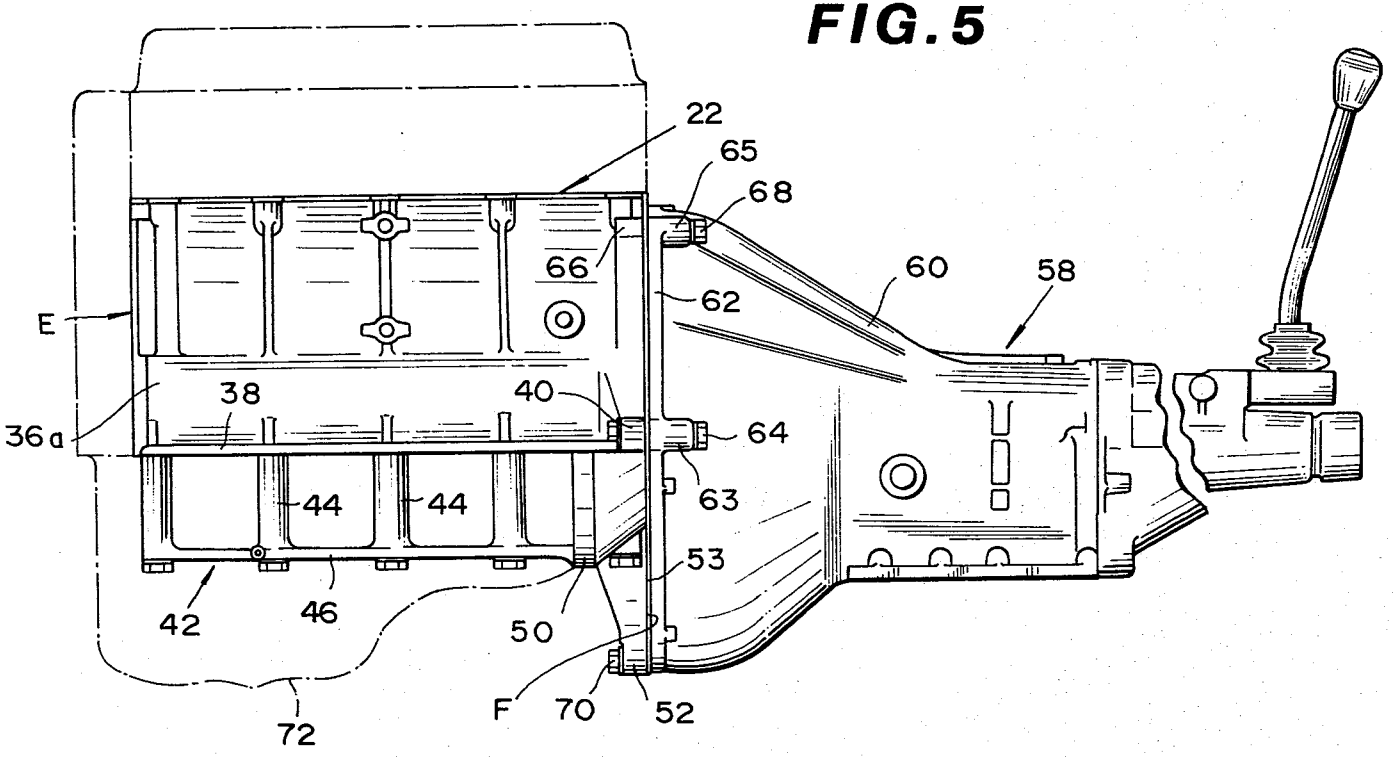
FIG. 5 is a side elevation showing the state wherein the engine according to the present invention is connected to a transmission.

FIG. 5 shows an assembled power plant in which a transmission 58 is installed through the rear plate 53 to the rear end section of an engine block E including the cylinder block 22 provided with the bearing beam structure 42. The transmission 58 has a bell housing 60 which is secured at its front end section to the rear end section of the engine block E. The bell housing 60 is formed with a generally annular flange 62 which is located along the periphery of the open end section of the bell housing 60. The bell housing flange 62 is provided at its opposite sides with two boss portions 63 which are rigidly connected to the transmission installation sections 40 of the cylinder block 22 by using bolts 64, respectively. The bell housing flange 62 is further provided at its upper two locations with two boss portions 65 which are rigidly connected to two boss sections 66 formed at the upper part of the cylinder block 22 by using bolts 68, respectively. Additionally, the bell housing flange 62 is rigidly connected at its bottom section to the arm section 52 of the bearing beam structure 42 by using the bolt 70 passing through the hole 54. An oil pan 72, secured to the bottom part of the skirt section **36*a*, is formed at its rear end section with a generally semicircular opening section (not shown) which fits along the outer periphery of the semicircular rib 50 of the bearing beam structure 42**.

With the thus arranged engine, the transmission bell housing 60 is rigidly connected through the whole periphery of its flange section 62 to the engine block E by means of bolt connections. This increases the surface area of connection between the transmission 58 and the engine block E, thereby greatly improving the flexural and torsional rigidities of the connecting section through which the transmission 58 is connected to the cylinder block E. Furthermore, the reinforcement ribs 38 formed at the opposite sides of the cylinder block 22 strengthen the transmission installation sections 40 while contributing to an improvement in the flexural rigidity of the cylinder block 22 in its lateral direction. Moreover, since the bearing cap sections 44 are connected through the beam section 46 to form a single piece, the cap sections 44 are not subjected to severe vibration which could cause them to loosen. In addition, since the bearing beam structure 42 is rigidly restrained through the arm section 52 to the transmission 58, the total vibration and flexural deformation of the bearing beam structure 42 is effectively suppressed.

Figure 8:
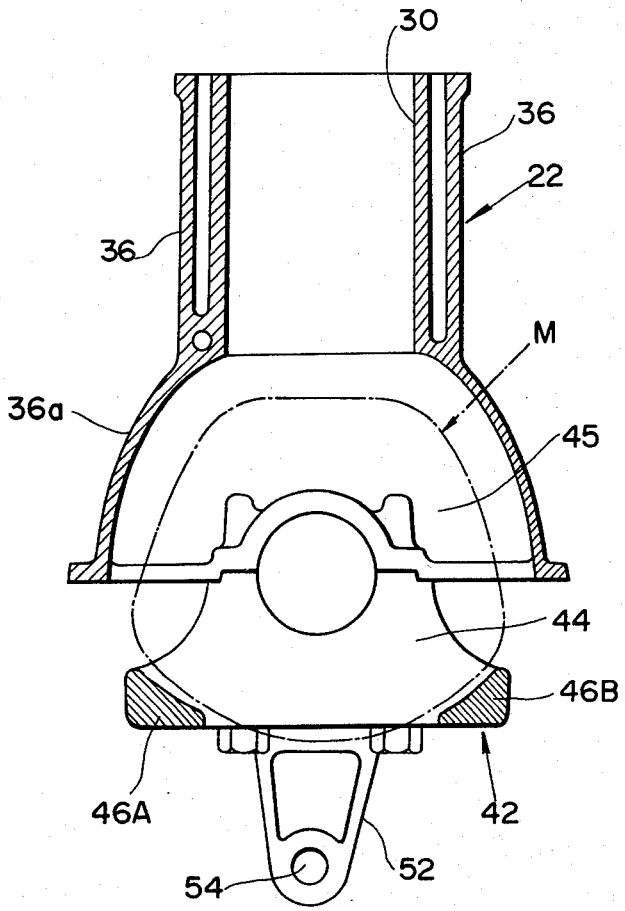
FIG. 8 is a sectional view similar to FIG. 3, but shows another embodiment of the engine in accordance with the present invention.

FIG. 8 illustrates another embodiment of the engine according to the present invention. In this embodiment, the bearing beam structure 42 includes two beam sections 46A and 46B which extend along the longitudinal axis of the cylinder block 22 and are spaced from each other. The two beam sections 46A, 46B are located respectively along the opposite side portions of the bottom part of each bearing cap section 44. In this instance, the two beam sections 46A, 46B are positioned generally symmetrical to each other with respect to a vertical plane which contains the longitudinal axis of the cylinder block 22. It will be understood that the beam sections 46A, 46B are located outside of the envelope M of the outer-most loci of the big end of a connecting rod (not shown).

As appreciated from the above, according to the present invention, the connection stiffness of the engine block to the transmission is effectively improved, thereby lowering vibration noise due to the angular displacement of the cylinder block to the transmission. Additionally, the various sections of the cylinder block are prevented from noise generation due to the comming-down vibration of bearing caps thereby to attain engine noise reduction. Furthermore, propeller shaft run-out can be effectively suppressed so as to allow the critical rotational speed of a propeller shaft to rise.

What is claimed is:

1. An internal combustion engine for an automotive vehicle having a transmission with a bell housing connected to said engine, said bell housing having a peripheral section which defines a bell mouth, said engine comprising:

a cylinder block having a bottom section comprising a plurality of main bearing supports;

a bearing beam structure secured to the bottom section of said cylinder block and including a plurality of main bearing caps which cooperate with said plurality of main bearing supports, and a beam section for securely connecting said main bearing caps together; and a support arm projecting from an end portion of said bearing beam structure closest to the transmission, and extending downwardly relative to said cylinder block, said support arm being rigidly connected only to a lower section of said bell mouth which is spaced from said cylinder block and only below a plane through which said beam section extends.

2. An internal combustion engine as claimed in claim 1, wherein said beam section of said bearing beam structure has openings, said opening being disposed between adjacent bearing caps.

3. An internal combustion engine as claimed in claim 1, wherein said beam section includes two spaced apart beam members, each of said beam members being disposed on an opposite side of said main bearing caps.

4. An internal combustion engine as claimed in claim 1, wherein said support arm has a surface for contacting a plate member associated with the transmission bell housing; said surface being aligned with a rear surface of said cylinder block to which the bell housing is attached through said plate member.

5. An internal combustion engine as claimed in claim 4, wherein said support arm has a hole for receiving a bolt which connects said support arm to said bell housing.

6. An internal combustion engine as claimed in claim 4, wherein said cylinder block includes two opposing side walls, a lower part of each side wall at least partially defining an upper section of a crankcase, said lower part of each side wall being generally straight to reduce noise radiation surface.

7. An internal combustion engine as claimed in claim 6, wherein said cylinder block includes reinforcement ribs disposed proximate to a bottom edge of each of said opposing side walls, said ribs being operable to support a transmission installation section which projects outwardly from said cylinder block.

8. An internal combustion engine as claimed in claim 6, wherein said cylinder block further comprises a cylinder-barrel structure including a plurality of cylinder barrels and an outer wall at least partially formed by said opposing side walls, said cylinder-barrel structure being spaced, at least at a top part thereof from said outer wall to define therebetween a water jacket.

9. An internal combustion engine as claimed in claim 8, wherein adjacent cylinder barrels are connected by a connecting section, said connecting section having a hole therein for providing communication between portions of said water jacket on opposite sides of said cylinder barrels.

* * * * *